United States Patent [19]

Fischer et al.

[11] Patent Number: 5,052,896

[45] Date of Patent: Oct. 1, 1991

[54] REGULATING VALVE FOR A HYDRAULICALLY ADJUSTABLE CONTROL PUMP

[75] Inventors: Günter Fischer, Gemünden; Rainer Knöll, Burgsinn; Horst Fischer, Lohr, all of Fed. Rep. of Germany

[73] Assignee: Mannesmann Rexroth GmbH, Lohr, Fed. Rep. of Germany

[21] Appl. No.: 549,941

[22] Filed: Jul. 9, 1990

[30] Foreign Application Priority Data

Jul. 8, 1989 [DE] Fed. Rep. of Germany ..... 3922829

[51] Int. Cl.[5] ..... F04B 49/08

[52] U.S. Cl. ..... 417/220; 418/26

[58] Field of Search ..... 417/220, 221; 418/26

[56] References Cited

U.S. PATENT DOCUMENTS 4,035,105 7/1977 Dantlgraber ..... 417/220
4,674,956 6/1987 Dantlgraber ..... 417/220

FOREIGN PATENT DOCUMENTS 2516765 10/1976 Fed. Rep. of Germany .
3420990 12/1985 Fed. Rep. of Germany .
3443265 6/1986 Fed. Rep. of Germany .
3503491 8/1986 Fed. Rep. of Germany .

*Primary Examiner*—Leonard E. Smith
*Assistant Examiner*—David W. Scheuermann
*Attorney, Agent, or Firm*—Cushman, Darby & Cushman

[57] ABSTRACT

A hydraulic circuit comprising a control pump having first and second adjustment means for changing the output volume of fluid pump, and a regulating valve adapted to suppy user means with a pressurized liquid.

3 Claims, 1 Drawing Sheet

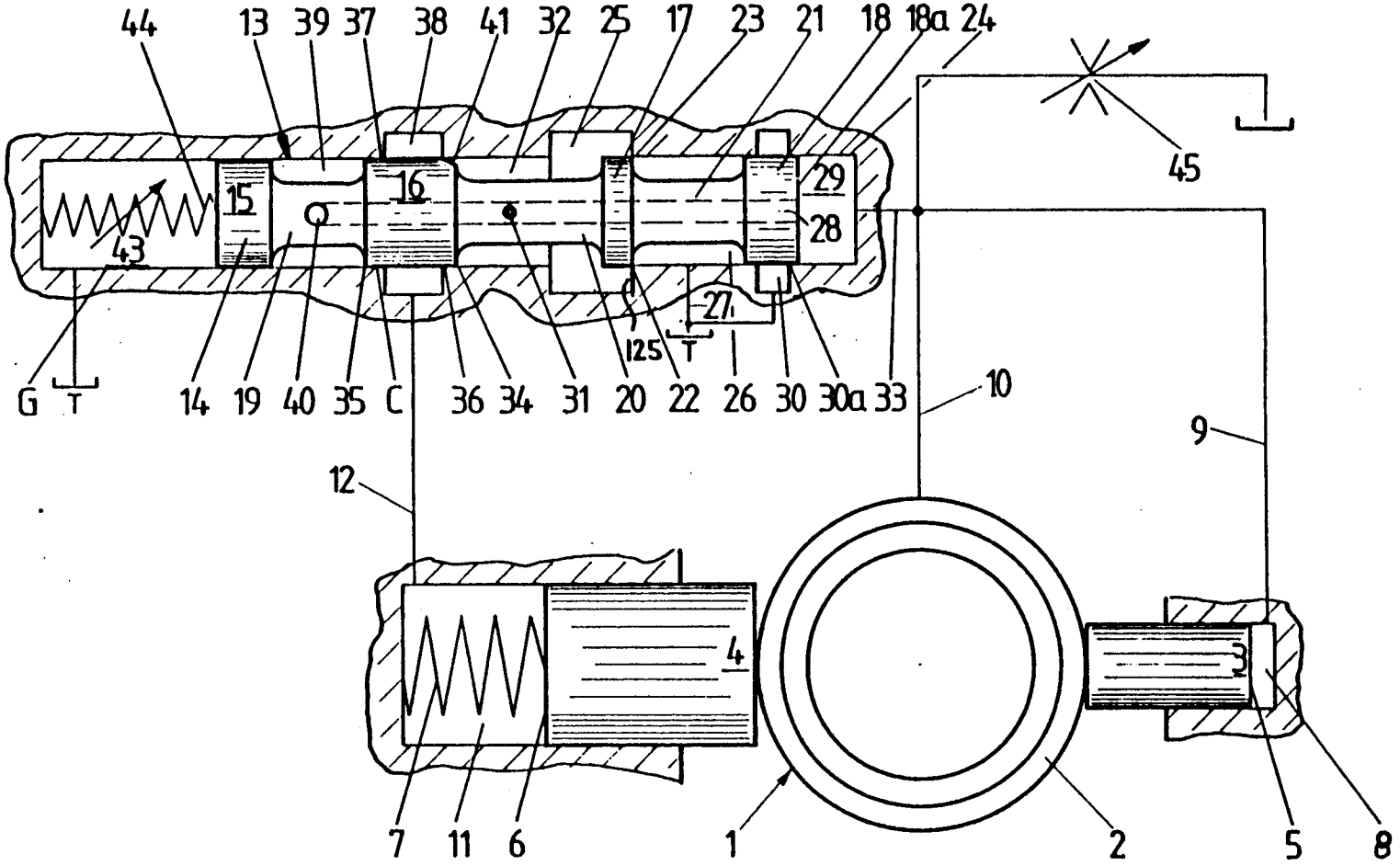
8
5
9
45
2
10
24
18a
18
33
29
28
30a
30
21
26
23
27
T
22
17
125
20
25
31
32
34
41
36
38
16
C
37
35
12
39
40
13
19
15
14
44
43
T
G
4
1
6
11
7

REGULATING VALVE FOR A HYDRAULICALLY ADJUSTABLE CONTROL PUMP

The invention relates to a regulating valve for a hydraulically adjustable control pump, i.e. a pump which can be controlled to supply a desired amount of hydraulic fluid or liquid.

German Patent 25 16 765 discloses a regulating valve for a hydraulically adjustable control pump, for instance a vane pump. The regulating spool of said known regulating valve is provided with a plurality of lands (control spool sections) and with undercuts formed by spool neck portions located between said lands. A blind bore extends through said regulating spool and is provided at its inlet with a constant throttle means. The constant throttle means cooperates with changeable throttle means, so as to generate the control pressure for changing the amount of hydraulic liquid (pressure medium) supplied by the pump. The changeable throttle means is formed by a control edge of a land of the control spool in cooperation with a control edge formed by the housing of the regulating valve. The last-mentioned control edge borders a chamber in the valve housing which is connected to the tank. Between the fixed throttle means and the control chamber of the pump an uncontrolled or unregulated connection is provided via a control edge of a second land, if the supply requirement of fluid (or liquid) for the users is abruptly increased and thus the pump has to be adjusted to a higher amount of supply (supply volume). In this process, the speed of adjustment of the pump is limited in upward direction by the free cross section of the fixed throttle means.

Other prior art is disclosed in the following German documents: 34 20 990 and 34 43 265.

It is an object of the present invention to provide for a regulating valve of the type shown in German patent 25 16 765 such that an adjustment of the pump for larger supply volume can occur independently of the size of the fixed throttle means, so that a very fast adjustment of the pump is guaranteed.

In accordance with another object of the invention, the adjustment of the pump is to be improved in the direction of smaller supply volumes.

In accordance with one aspect of the invention a control valve is provided which comprises a regulating valve for a hydraulically adjustable control pump, said valve comprising:

a housing (G), a guide bore extending in said housing (G), and a regulating spool reciprocably mounted within said guide bore, said regulating spool comprising:

a plurality of lands, a first end face subjected to pump pressure, a second end face subjected to the force of a spring acting in a direction against said pump pressure, a (first) control chamber located between two lands and adapted to be supplied by said pump with pressure liquid flow limited by a fixed throttle means, said one land bordering said control chamber defining a control edge which opens a controlled or regulated throttle cross section to the tank (T), the other land bordering the control chamber providing in the control or regulating position of the regulating spool a throttle connection to the pump control chamber, said land further providing for a direct connection between the (first) control chamber located between said two lands and the pump control chamber in case that a large regulating movement or deviation of the regulating spool occurs in the (leftward) direction in which the pressure acts upon said regulating spool, the land providing the throttle connection to the pump control chamber defines on its side opposite to the throttle connection together with another land a (second) control chamber, said (second) control chamber is connected via a bore in the regulating spool with the pressure side of the pump, and is further adapted to be directly connected to the pump control chamber in case that pressure decrease occurs, wherein the control chamber which is located between the land and the other land is connected with the pressure side of the pump in an unthrottled manner, and wherein said (second) control chamber bordered by said other land is connected with said pressure side of the pump in an unthrottled manner.

In accordance with another aspect of the invention a regulating valve for a vane pump is provided a regulating spool which comprises an axially extending blind bore connected with the pressure side of the pump, a first transversal or cross bore leading from said blind bore to the control chamber, which can be connected with the tank and/or the pump control chamber, and a second transversal or cross bore leading from said blind bore to the control chamber bordered by the other land, wherein the first transversal bore is formed as a throttle.

In accordance with another aspect of the invention a control valve for a vane pump is provided with comprises an adjustably movable cam ring which is held in the direction of movement by two oppositely located hydraulic adjustment pistons, a first one of said adjustment pistons is adapted to exert pressure onto said cam ring in the direction of larger supply volumes, and the second of said hydraulic adjustment pistons is adapted to apply a force to said cam ring in the direction of lower supply volumes, said first adjustment piston can be subjected, in addition to the control liquid, to the force of a spring which is located in a control chamber, said first adjustment piston comprises a larger cross section which can be subjected to pressure, than said second adjustment piston, said regulating valve which controls the pressure of the control liquid in a control chamber comprises a regulating spool which is subjected on one end face to the pump pressure and on the other end face to a control spring, said regulating spool further comprising a first land adapted to connect the control chamber via a discharge channel to a chamber having a lower pressure lever, and said control spool further comprising a second land by means of which the control liquid can be guided to said control chamber, wherein a) the second land is surrounded by a recess in the housing of the valve, said recess being connected with said control chamber, b) the length of said recess is smaller than the length of the second land, c) the second land is approximately symmetrical with respect to said recess, when said control edge of the first land has just closed the discharge channel to the chamber of low pressure level, d) at the second land at least one groove is provided, which connects said recess with the spool chamber facing towards said first land, e) the spool chamber located on one side of said recess is connected directly to pump pressure, and f) the spool chamber located on the other side of said recess is connected via a throttle means to the pressure side of the vane pump.

The single drawing shows, as an example of a control pump, a vane pump 1 having an adjustable cam ring 2. A vane pump of this type is shown in the above-mentioned German patent no. 25 16 765. Further, the book "The Hydraulic Trainer", published by G. L. Rexroth GmbH, 1981 shows pumps of the type shown in the drawing at pages 40–45.

By means of a hydraulically actuable adjusting piston 4 the cam ring 2 can be moved in the direction of increasing the displacement or output or supply volume of the pump 1. By means of a hydraulically actuable adjustment piston 3 the cam ring 2 can be moved in the direction of a decrease of the supply volume. The surface 5 of the adjustment piston 3 which is subjected to pressure, is smaller than the surface 6 of an oppositely located adjustment piston 4. In addition, the adjustment piston 4 is biased in the direction towards the cam ring 2 by means of an opening control spring 7.

A control chamber 8 for the adjustment piston 3 is provided, and is connected via a conduit 9 directly to the pressure conduit (also called "pressure side ") 10 of the vane pump 1. A control chamber 11 for the adjustment piston 4 is operatively connected via a conduit 12 with a control or regulating valve 13.

The regulating valve 13 comprises a valve housing 6 having a guide bore 24 adapted to receive a regulating (or control) spool 14 which, in turn, forms control spool sections or lands 15, 16, 17, and 18, and spool neck portions 19, 20, and 21 located therebetween. The land 17 comprises a control edge 22 which cooperates with a respective control edge 23. The control edge 23 is formed by the guide bore 24 and by a side wall 125 of a recess or bore 25 in the regulating valve housing G.

A chamber 26 is defined (or bordered) by the spool neck portion 21 (having a smaller cross section than the lands 17 and 18), together with the two lands 17, and 18. A passageway 27 extends through said housing G and connects said chamber 26 with a tank T.

The regulating spool 14 is provided with an axially extending blind bore 28. The blind bore 28 is connected with a throttle bore 31 forming a fixed throttle. The throttle bore 31 extends transversely through said regulating spool and connects a chamber 32—which is defined by the spool neck portion 20 and the lands 16 and 17—with a control chamber 29 of the regulating valve 13. The control chamber 29 is, in turn, directly connected with the pressure conduit 10 of the vane pump 1 by means of a conduit section 33.

Control edges 34 and 35 are formed by the land 16 and cooperate with the control edges 36 and 37 which are formed by the guide bore 24 and the side walls defining or bordering a bore (or recess 38) in housing G.

In the shown position of the regulating spool 14, the control edge 22 of land 17 is located in an exact closing position with respect to the control edge 23, and the control edges 34 and 35 of the land 16 overlap with the control edges 36 and 37 (of the housing G) by an amount C. Recess 38 forms a space or chamber with which the conduit 12 is connected. Conduit 12 is also connected to the control chamber 11 of the adjustment piston 4. To provide a connection between the chamber formed by recess 38 either with the spool chamber 32 or a spool chamber 39, chambers which are defined or bordered by the spool neck portion 20 and 19, respectively, it is initially necessary to move the regulating spool 14 by said amount C. The spool chamber 39, bordered by the spool neck portion 19, is also connected to the blind bore 28 via a transversal bore 40, and thus the spool chamber 39 is connected with the control chamber 29.

The land 16 is provided with at least one throttle groove 41. In the shown initial position of the regulating spool 14 said control groove 41 connects the spool chamber 32 with the housing recess 38; further, the control chamber 11 of the adjustment piston 4 is connected with the control chamber 29, and thus with the pressure conduit 10 of the vane pump 1 by means of a conduit, and by means of the bores 31 and 28. Thus, in the shown initial position of the regulating spool 14 the two adjustment pistons 3 and 4 are subjected to pump pressure.

Because the area 6 of the adjustment piston 4 (which is subjected to pressure) is larger than the area 5 of the adjustment piston 3 (which is subjected to pressure) and, in addition, due to the action of the opening control spring 7 the cam ring 2 is moved in the direction of maximum displacement volume of the vane pump 1 (i.e. rightwardly in the drawing) for the initial position of the regulating spool 14.

In case the pump pressure increases to a point where the regulating spool 14 is moved (to the left) against the force of an adjustable control spring 44, the control edge 22 opens and thus connects the spool chamber 32 to tank T via the spool chamber 26 and the passageway 27. It should be noted, that the adjustable control spring 44 is located in a spring chamber 43 in the housing G, and the spring chamber 43 is connected to tank T. The consequence of the leftward movement of the regulating spool 14 is a decrease of the control pressure in the spool chamber 32 and consequently also a decrease of the control pressure in the control chamber 11 of the adjustment piston 4, because only a limited amount of control liquid can flow into the spool chamber 32 via the throttle bore 31. As soon as the control pressure in the control chamber 11 of the adjustment spool 4 has decreased to a point where the force caused by said control pressure acting on the adjustment piston 4 together with the force of the opening control spring 7 is smaller than the oppositely acting force caused by the pump pressure applied to the adjustment piston 3, the adjustment piston 3 will move the cam ring 2 leftward, i.e. in the direction towards the adjustment piston 4 and thus in the direction of a decreasing output volume of the pump. This movement of the cam ring 2 will occur up to a point, where the pump pressure again corresponds to the value set or adjusted at the control spring 44.

In case a user 45 connected to conduit 10, for instance a flow control means, suddenly changes its value, for instance by increasing the amount of working liquid, so that the pressure in the pressure conduit 10 is reduced by a corresponding amount, due to the force of the control spring 44, the regulating spool 14 will be moved in the direction towards the control chamber 29. This movement of the regulating spool 14 occurs by such an amount that the control edge 35 opens and connects the spool chamber 39 with the recess 38, while the control edge 22 interrupts the connection to the tank T. Thus, the control chamber 11 is directly connected with the pressure side of the vane pump 1, so that both adjustment pistons 3 and 4 are subject to the pump pressure. Consequently, the force exerted by the adjustment piston 4 onto the cam ring 2 is larger than the force exerted by the adjustment piston 3 onto the cam ring 2, so that the cam ring 2 is moved in the direction of maximum output volume of the control pump (vane pump 1), and, as a consequence, the pump pressure again increases. Now, the direct connection of the control chamber 11 of the adjustment piston 4 with the pressure side or pressure conduit 10 of the control pump (vane pump 1) is again interrupted due to the movement of the regulating spool 14 against the control spring 44 and due to the closing of the control edge 35, and a continued connection of the control chamber 11 of the adjustment spool 4 with the pressure side of the vane pump 1 is only maintained via the groove 41 acting as a dampening throttle.

In case that the user 45 reduces abruptly the consummation of working liquid, the pump pressure will abruptly increase, so that the regulating spool 14 will be moved against the force of the control spring 44 by a correspondingly large amount. During this movement the control edge 34, circumventing the groove 41, opens the connection of the control chamber 11 with the spool chamber 32. The spool chamber 32, in turn, is connected to the tank T due to the simultaneous opening of the control edge 22. At the same time the control chamber 29 is directly connected with the tank T by means of a control edge **18*a* located in the control chamber 29 and via a control edge 30*a* formed by the bore 30. Thereby a particularly fast pressure relief occurs in the control chamber 11. Now, the cam ring 2 is moved by the adjustment piston 3, which is subjected to pump pressure, into the direction of minimum output volume of the control pump 1, whereby, with decreasing output volume the pump pressure will again be decreasing so that the regulating spool 14 will again be moved in the direction of the control chamber 29 due to the force of the regulating spring 44**.

As soon as the control edge **18*a* passes the control edge 30*a* and thus interrupts the direct connection of the pump pressure side 10, 33, 29 to the tank, and as soon as the control edge 34 interrupts the connection of the spool chamber 32 with the control chamber 11, only the connection via the groove 41 remains as a throttling connection between the two chambers (spool chamber 32 and control chamber 11), whereby a dampening effect occurs with respect to a further movement or adjustment of the adjustment piston 4. By means of groove 41, which causes a dampening of the regulating movement of the adjustment piston 4, simultaneously an excess movement of the regulating spool 14 and thus a repeated connection of the control chamber 11 directly with the pressure side of the pump and the tank, respectively, is effectively avoided while at the same time a high responsiveness (sensitivity) of the adjustment piston 4 is maintained for a suddenly changing pump pressure. The dampening becomes therefore only effective after the adjustment process, which has to be regulated, is almost concluded. Due to the interaction of the control edge 22 and the throttle bore between the blind bore 28 and the control chamber 32** a particularly fast response of the regulating operation for abrupt pressure increases and pressure decreases and an effective dampening effect for small regulating deviations is guaranteed.

Summarizing it can be said that the regulating valve of the invention is useful in connection with hydraulically adjustable controllable pumps, in particular a vane pump. The regulating valve of the invention guarantees that the output volume of the controllable pump is matched—in substance without any delay—with the amount of operating liquid required by the user.

We claim:

1. A regulating valve for a hydraulically adjustable control pump, said valve comprising:

a housing (G), a guide bore (24) extending in said housing (G), and a regulating spool (14) reciprocably mounted within said guide bore (24), said regulating spool (14) comprising:

a plurality of lands (15, 16, 17, 18), a first end face subjected to pump pressure, a second end face subjected to the force of a spring acting in a direction against said pump pressure, A (first) control chamber (32) located between two lands (16, 17) and adapted to be supplied by said pump with pressure liquid flow limited by a fixed throttle means (31), said one land (17) bordering said control chamber (25, 32) defining a control edge (22) which opens a controlled or regulated throttle cross section to a tank (T), the other land (16) bordering the control chamber (25, 32) providing in the control or regulating position of the regulating spool (14) a throttle connection (41) to a pump control chamber (11), said land (16) further providing for a direct connection between the (first) control chamber (32) located between said two lands (16, 17) and the pump control chamber (11) in case that a large regulating movement or deviation of the regulating spool (14) occurs in the (leftward) direction in which the pressure acts upon said regulating spool, the land (16) providing the throttle connection (41) to the pump control chamber (11) defines on its side opposite to the throttle connection (41) together with another land (15) a (second) control chamber (39), said (second) control chamber (39) is connected via a bore (40) in the regulating spool with the pressure side (10) of the pump (1), and is further adapted to be directly connected to the pump control chamber (11) pump in case that pressure decrease occurs, wherein the control chamber (39) which is located between the land (16) and the other land (15) is connected with the pressure side (10) of the pump in an unthrottled manner, and wherein said (second) control chamber (39) bordered by said other land (15) is connected with said pressure side (10) of the pump in an unthrottled manner.

2. The regulating valve of claim 1 wherein the regulating spool comprises an axially extending blind bore connected with the pressure side of the pump, a first transversal or cross bore (31) leading from said blind bore to the control chamber (25, 32), which can be connected with the tank and/or the pump control chamber (11), and a second transversal or cross bore leading from said blind bore to the control chamber bordered by the other land (16), wherein the first transversal or cross bore 31 is formed as a throttle.

3. A control valve for a vane pump, said vane pump comprising an adjustably movable cam ring which is held in the direction of movement by two oppositely located hydraulic adjustment pistons, a first one of said adjustment pistons is adapted to exert pressure onto said cam ring in the direction of larger supply volumes, and the second of said hydraulic adjustment pistons is adapted to apply a force to said cam ring in the direction of lower supply volumes, said first adjustment piston can be subjected, in addition to the control liquid, to the force of a spring which is located in a control chamber, said first adjustment piston comprises a larger cross section which can be subjected to pressure, than said second adjustment piston, said regulating valve which controls the pressure of the control liquid in a control chamber comprises a regulating spool which is subjected on one end face to the pump pressure and on the other end face to a control spring, said regulating spool further comprising a first land adapted to connect the control chamber via a discharge channel to a chamber having a lower pressure level, and said control spool further comprising a second land by means of which the control liquid can be guided to said control chamber, wherein a) the second land (16) is surrounded by a recess (38) in the housing of the valve, said recess (38) being connected with said control chamber (11), b) the length of said recess (38) is smaller than the length of the second land (16), c) the second land (16) is approximately symmetrical with respect to said recess (38), when said control edge (22) of the first land has just closed the discharge channel to the chamber of low pressure level, d) at the second land (16) at least one group (41) is provided, which connects said recess (38) with the spool chamber 32) facing towards said first land (17), e) the spool chamber (39) located on one side of said recess (38) is connected directly to pump pressure, and f) the spool chamber (32) located on the other side of said recess (38) is connected via a throttle means (31) to the pressure side of the vane pump.

* * * * *